United States Patent [19]

Bowling et al.

[11] 3,975,723

[45] Aug. 17, 1976

[54] DOOR ALERT SYSTEM AND MAGNETIC SWITCH THEREFOR

[75] Inventors: Roy E. Bowling, Denver; Arnold J. Buchtel, Lakewood; Dwight E. Keller, Denver, all of Colo.

[73] Assignee: Overhead Door Alert Company, Inc., Denver, Colo.

[22] Filed: May 14, 1975

[21] Appl. No.: 577,452

[52] U.S. Cl. ..... 340/274 R; 200/61.71; 340/282

[51] Int. Cl.[2] ..... G08B 21/00; G08B 13/08

[58] Field of Search ..... 340/274 R, 282; 335/206, 207; 200/61.71, 61.93

[56] References Cited

UNITED STATES PATENTS

| | | | |
|---|---|---|---|
| 2,877,361 | 3/1959 | Chase | 340/274 R |
| 3,161,742 | 12/1964 | Bagno | 340/274 R |
| 3,569,928 | 3/1971 | Avallone | 340/274 R |

*Primary Examiner*—Glen R. Swann, III
*Attorney, Agent, or Firm*—Reilly and Hancock

[57] ABSTRACT

A circuit for energizing an annunciator or warning device is actuated whenever a door or the like is in any position other than in proximity to preselected locations such as the two ends of intended travel. Proximity detectors arranged in conformity with the limits of intended travel effect electrical switching so as to interrupt the annunciator circuit whenever the door is within acceptable distance of the limits. The proximity detectors can be provided by a dual magnetic arrangement with one magnet associated with travel and the other permanently affixed relative to a reed switch or the like. The fixed magnet maintains the reed switch closed except when its magnetic field is effectively cancelled by the movable magnet.

9 Claims, 11 Drawing Figures

DOOR ALERT SYSTEM AND MAGNETIC SWITCH THEREFOR

BACKGROUND OF THE INVENTION

The present invention relates to apparatus and processes for indicating the general location of a movable member and further to a magnetic switch arrangement particularly useful in conjunction therewith. More particularly, the present invention is related to systems and processes for indicating the location of a movable member such as an overhead door and for correlating this position indicative to the relationship with respect to proximity of limits of travel for such doors. Although not necessarily limited thereto, the present invention is especially useful in conjunction with large overhead doors such as are typically employed in garages, warehouses and the like.

Powered overhead doors have been extensively adopted for a wide variety of uses. The hazards associated with such power doors have been recognized for some time and thus there have been a variety of efforts directed toward developing warning systems to prevent injury to persons and/or property as a result of impacting a door in motion. A typical such system is shown in U.S. Pat. No. 2,758,836 by Purdy wherein a warning light is associated with the motor drive mechanism employed in conjunction with an overhead door. A generally similar approach was earlier suggested in U.S. Pat. No. 1,951,905 by Hansen. A primary disadvantage of such systems is that they are generally only operative during such periods of time as power is being applied to the door drive mechanism. Thus, they are effective to warn those in the vicinity while the door is moving but do not provide any warning in the event that the door is actually stopped in other than its maximum limit positions. This means that an overhead door which has stopped below a predetermined limit for a vehicle would not result in any warning to a vehicle operator who may impact the door believing that sufficient clearance existed. An apparatus for indicating proximity of a metal body to sides of a device is shown in U.S. Pat. No. 3,493,925 by Brancale but such an arrangement is not well suited for detecting intermediate door stop positions for overhead doors.

A variety of magnetically operated switch proximity detectors have also been developed in the past. For instance, various applications of magnetically closed reed switches are generally shown in U.S. Pat. Nos. 3,648,817 by Siegel; 3,251,962 by Jones; 3,623,585 by Mason; 3,710,369 by Takahashi and 2,624,792 by Fruh. However, none of the magnetically operated switch devices are well suited for use in environments which can only accommodate relatively loose magnetic circuit couplings as in commercial overhead door installations.

SUMMARY OF THE INVENTION

The present invention is particularly useful for providing annunciator or warning device actuation whenever an overhead door or the like is located in positions other than in proximity to preselected locations such as the limits of its intended travel. Proximity detectors are located at the ends of the intended travel relative to a guiding framework or the like and continuously actuate an annunciator circuit during all times that the door is other than in proximity to the limits. This result is effected by affixing a detectable signal emanating device to the traveling member and placing devices sensitive to the emanated signals in the area of the intended limits of the door travel. As will be described in association with the preferred embodiment below, a particularly advantageous means for producing the position sensing signal is to employ a relatively large permanent magnet on the traveling member and affix magnetically sensitive detector devices in the general area of the intended travel limits. By including switches which are closed other than when the permanent magnet is within a preselected distance of the detectors, these switches maintain the annunciator circuit continuously closed except when the large permanent magnet is in the selected positions.

Further, a dual magnet reed switch arrangement of novel configuration is employed in the present invention. One permanent magnet is maintained in fixed relation to a reed switch so as to continuously maintain it in the closed contact condition. A larger permanent magnet is brought into appropriate relationship to the smaller fixed magnet so as to effectively overcome the magnetic field thereof and thus release the switch contacts.

By use of the novel apparatus and process of the present invention, a series of advantages are obtained which are not available with prior art devices. For instance, safety in association with an overhead door is enhanced since the failure of an overhead door to reach a fully open position will be continuously reflected by the annunciator. Such a warning significantly reduces the prospects of damage or injuries resulting from an attempt to move a vehicle through the door which normally has sufficient clearance but does not because of failure of the door to fully open. This hazard is particularly significant for warehouses wherein forklifts are employed for handling large loads. Still further, the system operates as a burglar alarm since any attempt to open the door will result in actuation of the annunciator thereby reflecting the unauthorized entry attempt. In addition, the failure of the door to completely close so that exposure to weather, loss of heat and the like exists will also be reflected by operation of the annunciator. Yet another advantage of the present invention is that the annunicator will continue to operate in the event that a door no longer is reaching its fully opened or fully closed positions which are conditions indicating that maintenance of the door operating system is required. A particularly significant advantage of the present invention is that it will provide an annunciator output at any time that the overhead door is in positions other than predetermined or preselected limit positions and provide this output independently of the actuating mechanism associated with the movement of the door. It still further provides the full equivalent of door movement warning as effected by the prior art devices.

An object of this invention is to provide apparatus and processes for reflecting that a traveling member is located other than at preselected positions.

Another object of this invention is to provide an indication that an overhead door or the like is located at other than its general travel limits.

A still further object of this invention is to provide a system and process for detecting that a door is in proximity to its limits of travel or intermediate thereof and to provide a continuous indication of its positioning in an intermediate location.

A further object of this invention is to provide a novel dual magnetic switching operation particularly useful for proximity detection.

The foregoing and other objects, features and advantages of the present invention will be more apparent in the light of the following description of a preferred embodiment taken in conjunction with the accompanying drawings.

DETAILED DESCRIPTION OF THE PREFERRED EMBODIMENTS

Figure 1:
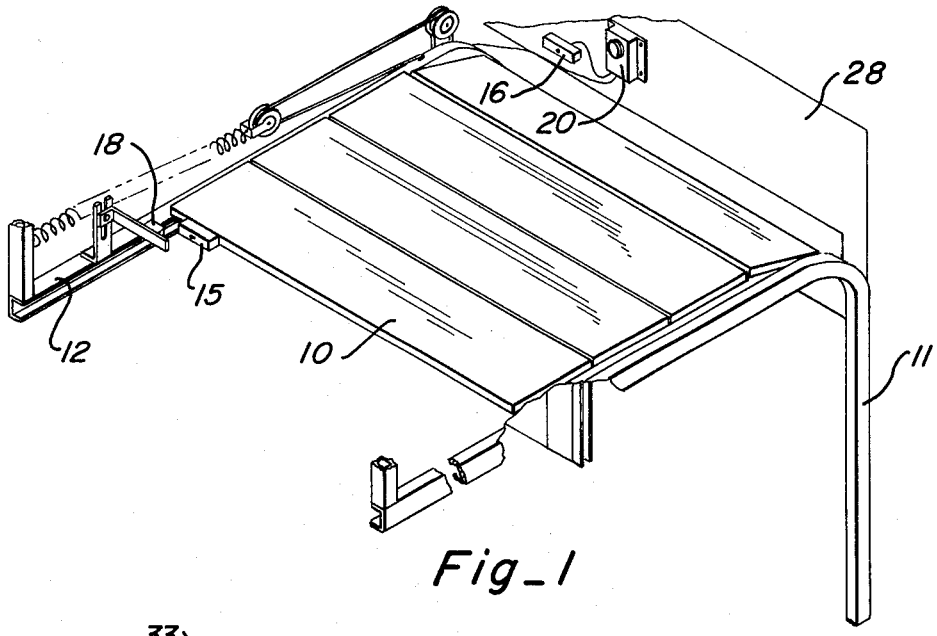
FIG. 1 is a perspective view of a typical overhead door installation including the present door alert system installed in association therewith.

FIG. 1 is a perspective view of a typical overhead door installation including the present invention attached in association therewith. More particularly, overhead door 10 is guided between tracks 11 and 12 substantially in the same way that it has been in the past. This door may be manually operated or separate driving mechanisms of the like which are commercially available can be included. An advantage of the door alert system in accordance with the present invention is that it is independent of whether or not the door is powered by any type of system or manually operated. The present invention contemplates inclusion of a position indicating signal emanating device attached to the door and signal detecting devices being positioned in association with limit positions for the travel of door 10.

Figure 2:
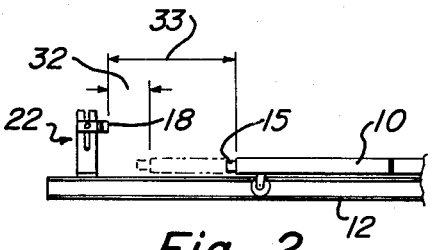
FIGS. 2 and 3 illustrate the interrelationship of the preferred embodiment with an overhead door in conjunction with its fully opened and fully closed positions, respectively.
Figure 3:
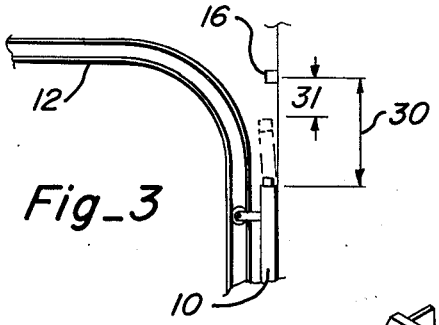

In the preferred embodiment as will be described, the signal emanating device is contemplated as a relatively large permanent magnet 15 attached to the upper edge of the door 10. In one version of the present invention, permanent magnet 15 is Model E65 or E65M produced by the Emergency Products Company of Newark, New Jersey. Proximity detectors 16 and 18 are positioned so as to be in the general vicinity of permanent magnet 15 whenever it is at its fully closed or fully opened position, respectively. Detectors 16 and 18 can be identical magnetic reed switch devices such as will be described in greater detail below and each provide a switching function for actuating an annunciator in enclosure 20 as will also be described below. Preferably, the switches associated with detectors 16 and 18 maintain an actuating position for the buzzer, light or other warning apparatus associated with enclosure 20 for all times that the door 10 is in other than the positions in proximity to its upper and lower limits of travel. These positions are generally shown in FIGS. 2 and 3. However, it should be understood that additional proximity detectors can likewise be included to detect location of door 10 at positions other than its upper and lower limits if this should be desirable or that detectors 16 and/or 18 can be located to sense other than extreme door travel limits.

Figure 4:
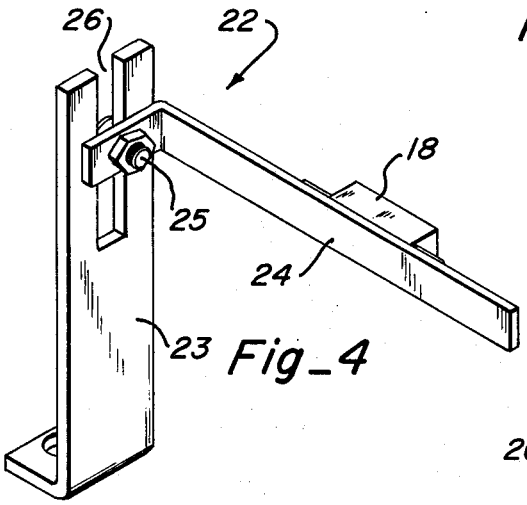
FIG. 4 shows an adjustable mounting bracket arrangement for a proximity detector.
Figure 5:
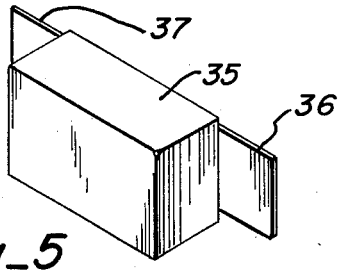
FIG. 5 is a perspective view of a proximity detector housing.

Detector 18 is preferably mounted to an adjustable arm assembly 22 which is shown in FIG. 4. More particularly, assembly 22 is comprised of an upright bar 23 which is rigidly attached to guideway 12 and which has extender arm 24 mounting detector 18 so that detector 18 can be positioned over the travel of door 10. A bolt 25 retains arm 24 relative to bar 23 but permits appropriate vertical adjustment within slot 26. Detector 16 as shown in FIG. 1 can be rigidly attached directly to the garage wall 28 but detector 18 must be arranged so as to be positionable in a location which is generally expected to be inconvenient relative to the main wall or walls of the structure into which door 10 opens. It will be fully appreciated that permanent magnet 15 in some circumstances could be attached in other positions on door 10 and other mounting arrangements included for detectors 16 and 18 if desired, but the particular configuration as shown in FIG. 1 is well-suited for avoiding any possible conflict of the detector apparatus with the door mechanisms. The main objective in mounting detector 16 is to insure that it will be clear of the arcuate travel of door 10 in its upward and downward movement yet will continuously detect the presence of the magnetic field emanated by magnet 15 for the full downward displacement such as dimension 30 illustrated in FIG. 3. Because of the hysteresis of the magnetic devices involved, the detector 16 will be actuated so as to open the annunciator circuit 20 whenever magnet 15 reaches a point which is a relatively short distance therefrom as illustrated at 31 in FIG. 3 or at 32 in FIG. 2. However, switches 16 and 18 thereafter remain in the open or actuated state for at least travels 30 and 33 of magnet 15 as shown in FIGS. 2 and 3.

Figure 9:
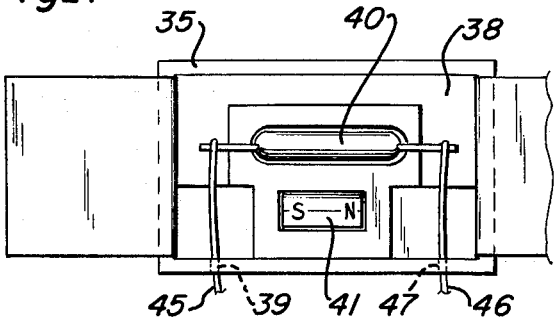
FIG. 9 is a bottom view of a reed switch proximity detector with the components in place therein.
Figure 9:
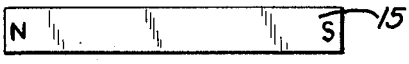

The details of a particular magnetic detector device well suited for use in conjunction with the present invention are shown in FIGS. 5, 7, 8 and 9 wherein a magnetically transparent enclosure housing 35 is adapted by ears 36 and 37 to be mounted upon a relatively stationary positioning frame or the like by any suitable means including bonding. As best seen in the exploded view of FIG. 7, a plastic or other magnetically and electrically inert inert 38 is arranged to fit within the enclosure 35 and retain a reed switch capsule 40 and a small permanent magnet 41 therein. Insert 38 with switch 40 and magnet 41 contained therein can be retained within enclosure 35 by any suitable means such as through pins, screws, rivets or the like or the entire assembly can be potted in place by a suitable inert material. This is generally illustrated in the sectional view of FIG. 8 which shows the elements in place and with the opening of the enclosure housing 35 being sealed by a plate, epoxy or the like 42. As is understood in the art, reed switch 40 is typically composed of normally separated cantilever mounted contacts 43 and 44 each of which are attached to electrical connectors extending from the capsule 40 and which can be connected to output leads 45 and 46 as shown in FIG. 9. Holes 39 and 47 are employed for extending leads 45 and 46 to be used in the appropriate circuit connections. In one embodiment of this invention, small permanent magnet 41 is of Alnico magnet stock of one-quarter inch diameter and has a length of approximately three-eighths of an inch. The reed switch 40 is any of a wide variety of such devices available commercially. Insert 38 holds magnet 41 in a position approximately one-eighth of an inch from switch 40. In any event, the arrangement of elements as shown in FIGS. 5, 7–9 without more will result in the normal closure of the contacts 43 and 44 thereby providing an electrical short between leads 45 and 46 for use to be described later. By orienting the larger permanent magnet 15 so that its magnetic field cancels the field applied to reed switch 40 by the smaller magnet 41, the contacts 43 and 44 will open as a result of their spring-type construction. It has been found that a relatively large displacement from a true parallel alignment between magnets 15 and 41 can be tolerated and still obtain acceptable switching functions thereby providing a particularly advantageous arrangement for overhead garage doors. Alignment of magnets 15 and 41 so that opposite magnetic poles thereof are closest to each other when magnet 15 approaches detectors 16 and 18 will be most effective. The magnetic pole alignment is illustrated in FIG. 9 wherein it should be recognized that magnet 15 in a suitable mounting enclosure is attached to door 10 as shown in FIGS. 1-3. Furthermore, it has been found that the switch will operate as intended even if reed switch 40 is positioned so as to be between magnets 15 and 41 instead of in the orientation shown in FIG. 9. It is believed that this provides a magnetic flux return path for each magnet through the other.

Figure 6:
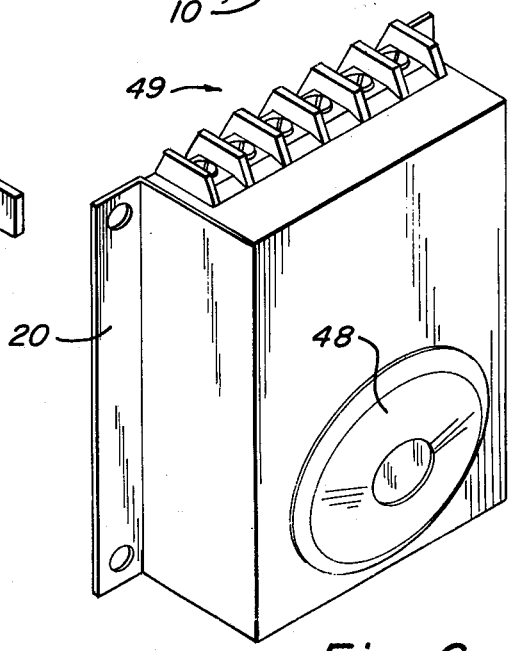
FIG. 6 illustrates an annunciator enclosure.
Figure 7:
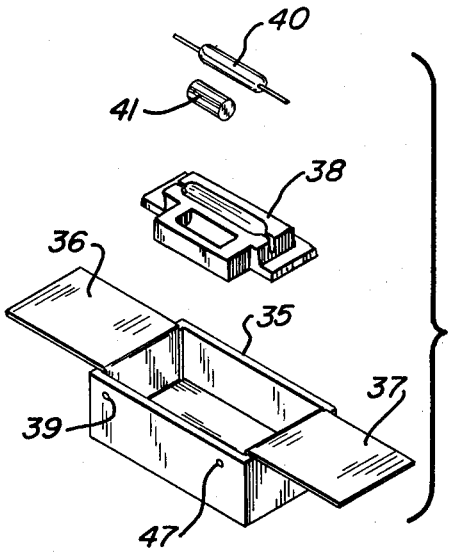
FIG. 7 is an exploded perspective view of the magnetic reed switch assembly included within the enclosure shown in FIG. 5.
Figure 8:
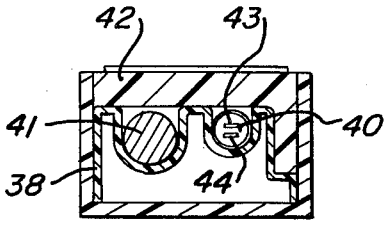
FIG. 8 is a cross-sectional view of a completed proximity detector assembly.
Figure 10:
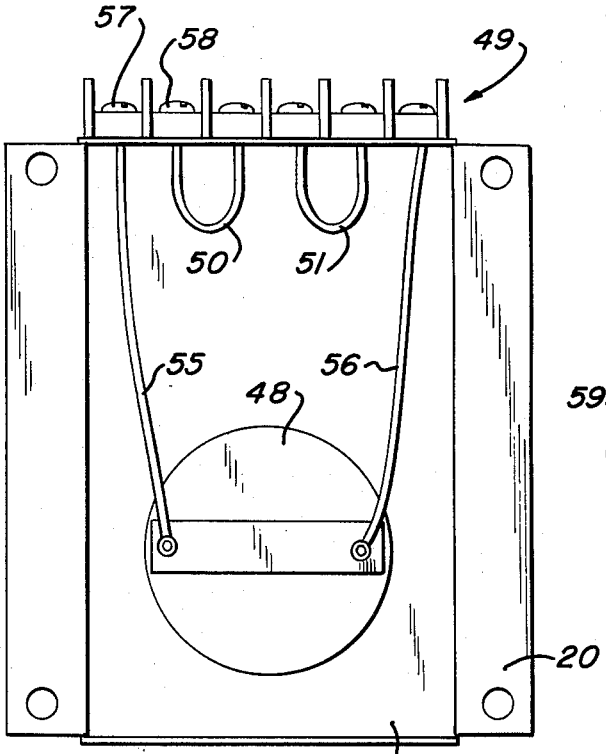
FIG. 10 shows the circuit connections associated with the annunciator enclosure of FIG. 6.

The annunciator found to be particularly useful for this invention is any of a wide variety of speaker-type devices 48 which might even be of the type which is directly actuable by 110 volts AC. The annunciator enclosure 20 is shown in FIGS. 6 and 10 and includes the speaker device 48 and a terminal connector board assembly 49 for convenience in circuit connections. FIG. 10 shows a rear view of the housing enclosure 20 and illustrates a typical set of circuit connections in association with terminal board 49. Note that, after jumpers 50 and 51 along with leads 55 and 56 for speaker 48 have been appropriately connected within the enclosure housing 20, the inner chamber 52 can be filled with an inert potting material so as to isolate it from the environment and retain the elements in place.

Figure 11:
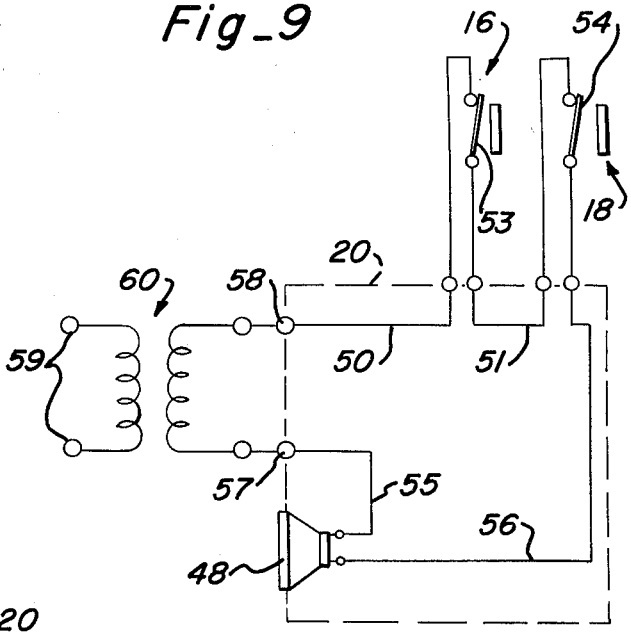
FIG. 11 is a schematic circuit diagram of the proximity switch and annunciator apparatus.

FIG. 11 illustrates a typical circuit diagram for employing the annunciator and two of the detector devices somewhat like those illustrated previously. Detector 16 is shown as controlling reed switch contacts 53 whereas detector 18 is shown controlling detector contacts 54. By including internal connections 50, 51, 55 and 56 as shown generally in FIGS. 10 and 11 into the terminal strip 49, the circuit is effectively completed between input terminals 57 and 58. Accordingly, by applying 110 volts AC to input 59 of transformer 60 and coupling the secondary of transformer 60 across input terminals 57 and 58, the annunciator 48 will be continuously actuated as long as reed switch contacts 53 and 54 are closed as shown in FIG. 11. Note that transformer 60 can be any suitable apparatus such as an isolation transformer, step-down transformer or the like. In any event, as long as the permanent magnet 15 attached to the door is sufficiently far from either detector 16 or 18, the small permanent magnets of detector assemblies 16 and 18 will maintain their switch contacts 53 and 54 closed as shown so that annunciator device 48 will be continuously actuated. As soon as the large permanent magnet is sufficiently close to either of detectors 16 or 18 as is shown at 31 and 32 in FIGS. 2 and 3, the reed switches will be opened thereby deactuating the annunciator 48 and thus reflecting that door 10 is within acceptable proximity to its upper and lower limits.

Thus it can be seen that the continuous operation of annunciator 48 can reflect any of a wide variety of different conditions. Namely, it indicates that the door is not within sufficient proximity of its upper or lower limits but this indication can further indicate that an unsafe condition exists, that the door operating mechanism requires maintenance attention, that an intruder is attempting forceable entry through the door, that the environmental isolation intended by the door is ineffective or the like.

It should be recognized that the orientation of the magnetic circuits for either permanent magnets 15 or the small internal permanent magnets 41 is immaterial with respect to the reed contact switches 40 so long as they are arranged so that the magnetic strength of the permanent magnet 15 will overcome the magnetic field emanating from the smaller magnets 41. the physical movement associated with this arrangement provides a relatively wide range as needed for an overhead door mechanism. That is, if magnet 15 is of sufficiently greater magnetic strength and sufficiently close to the detectors 16 or 18, it could not only cancel the permanent magnetic field from magnets 41 but could effectively replace that field and reclose the switch contact point. Using the specific elements mentioned previously for the invention, it has been found that this reclosing is effected at less than one inch spacing. Accordingly, it is only necessary to insure that the permanent magnet 15 does not approach the detectors 16 or 18 by a distance of less than one inch but preferably one and a half to two inches to insure it will not reclose the switch. It has been further found that the switch will break when a distance of approximately four inches occurs for distances 31 and 32 shown in FIGS. 2 and 3 and that the switches will reclose when separations 30 and 33 are eight inches or greater. It should also be recognized that housing 35 and insert 38 can be fabricated as a single piece assembly of magnetically transparent material.

While the novel features of the present invention have been shown and described in detail in conjunction with the foregoing exemplary preferred embodiments thereof, it will be readily understood by those having normal skill in the art that many changes, modifications, additions and applications other than those specifically mentioned herein may be made without departing from the spirit and scope of this invention.

What is claimed is:

1. A system for indicating the location of a member which is movable bidirectionally over a predetermined distance relative to a fixed structure comprising:

signal emanating means connected for moving in a predetermined path in response to movement of the movable member, at least two spaced signal detecting means each including an electrical switch means and means responsive to signals from said emanating means whenever said signals originate in a preselected zone in proximity to the associated said detecting means, each said switch means being operable by the associated said signal responsive means for assuming a first conductive state whenever signals from said emanating means are originating from within said preselected zone and for assuming a second conductive state otherwise, said detecting means being attached to the fixed structure so that respective said preselected zones are in spaced relation along said emanating means predetermined path, and annunciator means connected for responding to the concurrence of said second conducting state for all of said switch means for producing an output indicative that said signal emanating means is in a position along said predetermined path other than within one of said preselected zones.

2. A system in accordance with claim 1 wherein said signal responsive means of each said detecting means is a first magnet and said switch means includes a pair of magnetically movable contacts arranged for effecting electrical connection therebetween in response to the magnetic field of the associated said first magnet, said signal emanating means including a second magnet producing a magnetic field for counteracting the magnetic field of said first magnet whenever said second magnet is in said preselected zone so as to release the electrical connection between said contacts.

3. A system in accordance with claim 2 wherein said annunciator means includes a power source and an audible alarm device, said system further including means for serially interconnecting said power source, said alarm device and all of said switch means so that said alarm device produces an audible signal whenever said emanating means is not in one of said preselected zones.

4. A system in accordance with claim 3 for use where the movable member is an overhead door which is movable within fixed guiding tracks, said second magnet being attached to the overhead door, and said detecting means being attached relative to the guiding tracks for positioning said preselected zones thereof for entry by said second magnet in proximity to the full open and full closed positions of the overhead door.

5. A system in accordance with claim 4 wherein said detecting means each includes a housing and an insert contained therein both fabricated of magnetically transparent material, the associated said switch means including an encapsulated reed switch, said insert retaining the associated said first magnet and said reed switch in fixed relation for causing the said contacts of said reed switch to be electrically shorted whenever said second magnet is outside of said preselected zone, and means for sealing said insert within said housing.

6. A system in accordance with claim 5 which further includes at least one means for adjusting the attachment of a said detector for permitting selection of the location of the associated said preselected zone relative to the path of movement of said second magnet.

7. The method of providing a warning signal to indicate that a movable overhead door is located other than in its fully open or closed positions comprising the steps of:

energizing an audible alarm, generating a detectable signal from a location on the door, sensing the presence of the detectable signal whenever the door location is in proximity to a position corresponding to the fully open or closed positions, and energizing an audible alarm, and deactivating the audible alarm whenever the detectable signal is being sensed.

8. The method in accordance with claim 7 wherein said signal generating step includes the step of attaching a magnetic field generating device for movement with the door, said sensing step includes the step of attaching magnetic field sensitive devices in fixed positions relative to the door so as to be actuated by the magnetic field generating device, said deactuating step further includes the step of opening one of a series of electrical switches for removing power from the audible alarm whenever one of the magnetic field sensitive devices is detecting proximity of the field generating device relative thereto, and said energizing step includes the step of closing the electrical switches for applying power to the audible alarm whenever the magnetic field generating device is out of proximity to the magnetic field sensitive devices.

9. The method in accordance with claim 8 which includes the steps of applying a magnetic field source in fixed relation to each of the switches for normally and magnetically biasing the switch in the electrically closed position, and orienting the magnetic field generating device on the door for counteracting the magnetic bias from the sources and effecting electrical opening of the switch devices whenever the door is in the fully open or closed positions.

* * * * *

PO-1050
(5/69)

UNITED STATES PATENT OFFICE
CERTIFICATE OF CORRECTION

Patent No. 3,975,723 Dated 17 August, 1976

Inventor(s) Roy E Bowling, Arnold J. Buchtel & Dwight E. Keller

It is certified that error appears in the above-identified patent and that said Letters Patent are hereby corrected as shown below:

Column 4, line 52, cancel "inert" (2nd occurrence) and substitute --insert--.

Column 6, line 25, cancel "the" (2nd occurrence) and substitute --The--.

Claim 1, Column 7, line 8, cancel "means" and substitute --means'--.

Claim 7, Column 8, line 20, cancel "energizing an audible alarm, and"

Signed and Sealed this

Fourth Day of January 1977

[SEAL]

*Attest:*

RUTH C. MASON
*Attesting Officer*

C. MARSHALL DANN
*Commissioner of Patents and Trademarks*